US005899640A

United States Patent [19]

Yeh

[11] Patent Number: 5,899,640

[45] Date of Patent: May 4, 1999

[54] ANCHORING DEVICE

[76] Inventor: Yung-tien Yeh, 3F, No. 30, Lane 131, Chung-Hsiao Rd., Lu-Chou Hsiang, Taipei Hsien, Taiwan

[21] Appl. No.: 08/958,390

[22] Filed: Oct. 27, 1997

[51] Int. Cl.[6] ..... E21D 20/00

[52] U.S. Cl. ..... 405/259.1; 81/DIG. 2

[58] Field of Search ..... 405/259.1, 244; 411/55, 60; 248/156, 530, 545; 52/745.21; 81/62, 63.1, 124.2, 124.3, 125, 177.85, DIG. 2, 52, 54

[56] References Cited

U.S. PATENT DOCUMENTS 1,513,212 10/1924 Beale et al. ..... 81/DIG. 2

*Primary Examiner*—Tamara Graysay
*Assistant Examiner*—Sunil Singh
*Attorney, Agent, or Firm*—Smith, Gambrell & Russell, LLP; Beveridge, DeGrandi, Weilacher & Young Intellectual Property Group

[57] ABSTRACT

An anchoring device includes a cam rod having a pair of dual-spiral grooves thereon which are orthogonal to each other. The cam rod is provided with a pedal. A direction-switching device is enveloped onto the cam rod. An anchoring root is releasably engaged to the lower portion of the direction-switching device. The direction-switching device includes a driving wedge which is engaged with a socket of the anchoring root. The anchoring root can be engaged or disengaged with the direction-switching device. When the pedal is depressed, the direction-switching device can be driven by the spiral grooves of the cam rod. The anchoring root that is attached to the bottom of the direction-switching device is also rotated. The anchoring root is then screwed into the ground. After the anchoring root is positioned, the cam rod and the direction-switching device can be removed therefrom and a pole can be inserted into a pilot hole within the anchoring root.

9 Claims, 5 Drawing Sheets

ANCHORING DEVICE

FIELD OF THE INVENTION

The present invention relates to an anchoring device, and more particularly, to an anchoring device that can be conveniently screwed into the ground. The anchoring device includes a cam rod that is provided with a pair of spiral grooves that are orthogonal to each other. The cam rod is movably mounted with a direction-switching device. An anchoring root is releasably engaged with the direction-switching device and is driven into the ground while the direction-switching device is rotated. A pole can then be inserted into a pilot hole in the anchoring root.

DESCRIPTION OF THE PRIOR ART

When we need to erect a pole in the ground or on a slope in the outdoors, generally we need to dig a deep hole first and then place a pole into the hole. After the pole is erected in the hole, the evacuated soil is returned to the ground and compacted. Therefore, to erect a pole in the ground, one needs to dig a hole first. This is very inconvenient. The soil can never be returned to the ground and compacted as before, so that the erected pole can not be firmly supported at its lower end or root portion. If one needs to provide a firm support to an erected pole, a hole must be dug deeply and the soil must be returned and compacted. Since one often needs to erect a plurality of poles, it will take a great deal of time and effort, and one must bring a tool for digging. It can be readily appreciated that it is very inconvenient to erect a pole.

Another method of erecting a pole is through use of pegs and ropes. At least three ropes are first fastened onto the upper portion of the pole, and then the other end of the rope is fixedly attached to a peg that is anchored into the ground. Normally, the pegs are arranged in a triangular shape. Even when this method is feasible, one needs to have ropes and pegs. It can be readily appreciated that this is inconvenient for a person who needs to erect a pole.

Furthermore, if a person needs to erect a pole on a slope, or to mount a horizontal supporting rod between the walls of a cave or trench for hanging articles, it will be impossible to recompact the refilled soil in the wall, especially on a vertical wall. As a result, the root of the horizontal rod can not be firmly supported. Accordingly, it is nearly impossible to erect a horizontal supporting rod in a cave or trench.

SUMMARY OF THE INVENTION

It is an object of this invention to provide an anchoring device that can be readily driven into the ground for supporting an erected pole therein.

It is another object of this invention to provide an anchoring device that can be driven into an inclined wall or a vertical wall. By this arrangement, the anchoring device can be readily driven into the inclined wall or vertical wall, and a supporting rod can be horizontally supported therein.

Accordingly, an anchoring device is provided which includes a cam rod having a pair of dual-spiral grooves thereon, the spiral grooves being orthogonal to each other. The cam rod is provided with a pedal. A direction-switching device is enveloped onto the cam rod. An anchoring root is releasably engaged to the lower portion of the direction-switching device. The direction-switching device includes a driving wedge which is engaged with a socket of the anchoring root. The anchoring root can be engaged or disengaged with the direction-switching device. When the pedal is depressed, the direction-switching device can be driven by the spiral grooves of the cam rod. The anchoring root that is attached to the bottom of the direction-switching device is also rotatable. The anchoring root is then screwed into the ground. After the anchoring root is positioned, the cam rod and the direction-switching device can be removed therefrom, and a pole can be inserted into a pilot hole within the anchoring root.

In application, the anchoring root is first pressed against the ground and then the user steps on the pedal of the cam rod. When the cam rod is moved downward, the direction-switching device is rotated, and the anchoring root is driven into the ground. After the anchoring root is firmly supported, the cam rod and the direction-switching device are removed therefrom and a pole to be erected can be inserted into a pilot hole of the anchoring root.

When the anchoring root is screwed in, the density of the soil is further intensified and the anchoring root is firmly and substantially supported.

BRIEF DESCRIPTION OF THE DRAWINGS

In order that the present invention may more readily be understood, the following description is given, merely by way of example, with reference to the accompanying drawings, in which.

DETAILED DESCRIPTION OF THE PREFERRED EMBODIMENT

Figure 1:
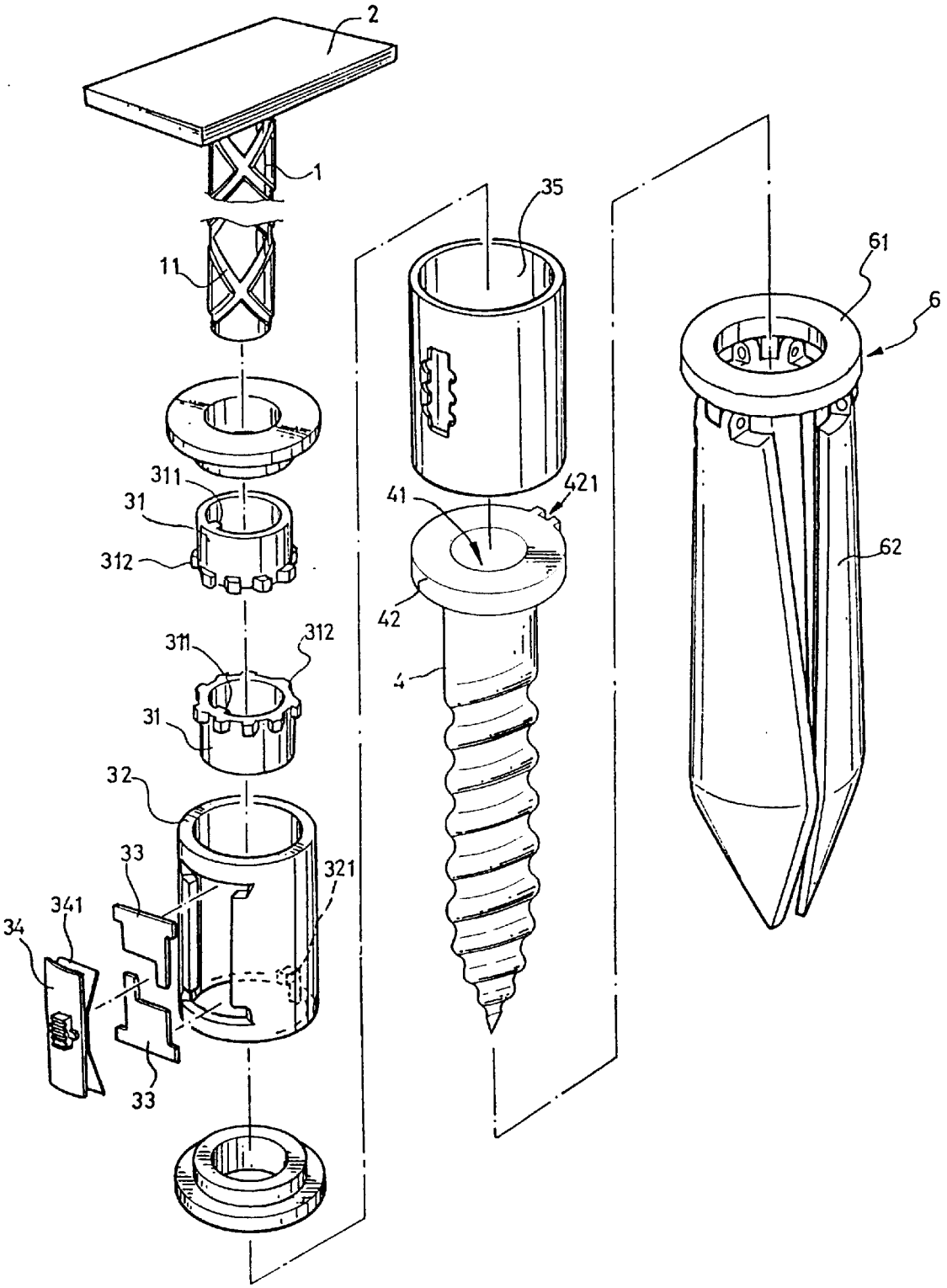
FIG. 1 is a perspective view of the anchoring device made according to the present invention.
Figure 2:
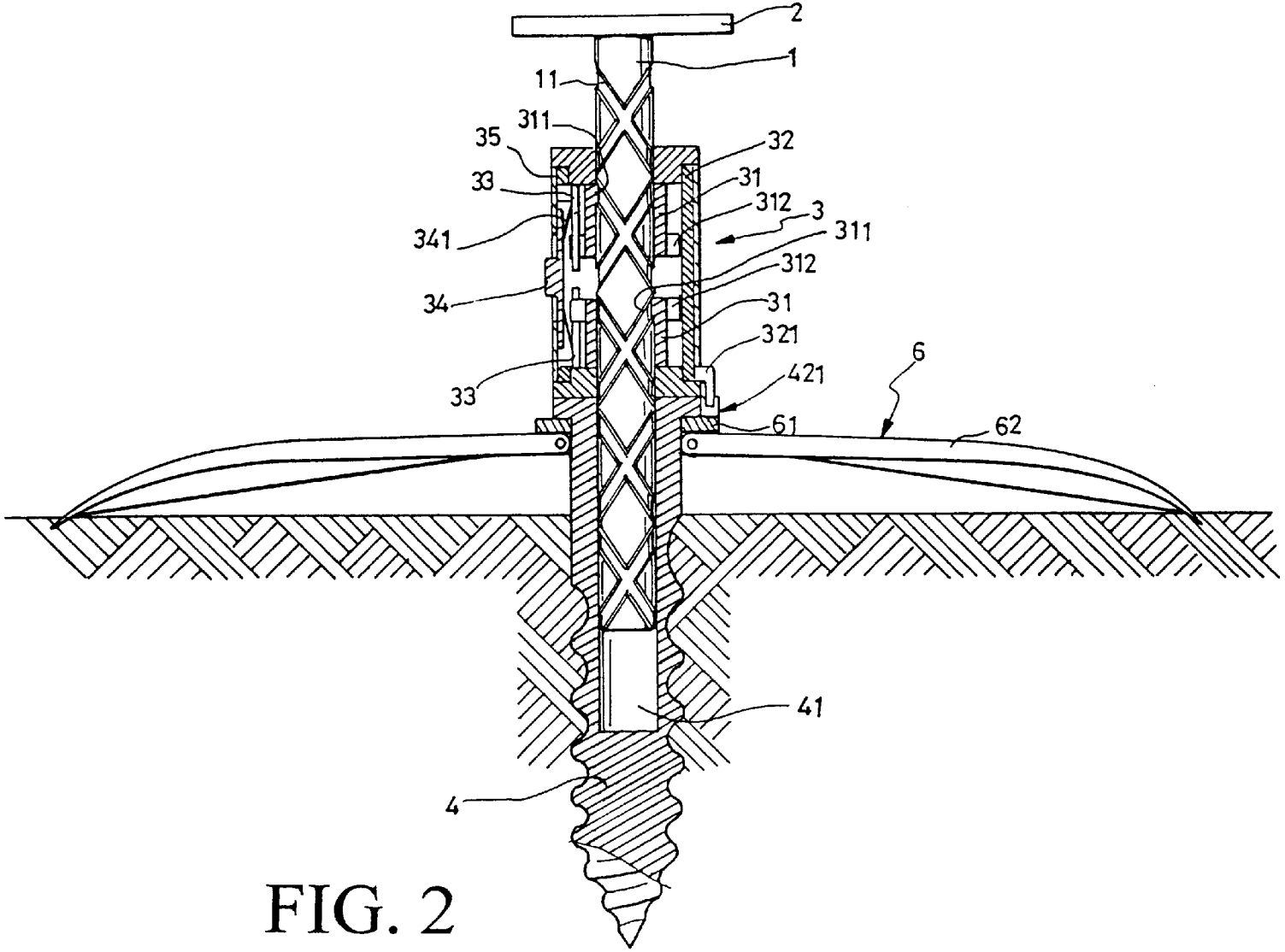
FIG. 2 is a cross sectional view showing the anchoring device screwed into the ground.

Referring to FIGS. 1 and 2, the anchoring device is configured with the following elements.

A cam rod 1 has an elongate shape and is provided with dual-spiral grooves 11 that are orthogonal to each other. The cam rod 1 further includes a pedal 2 mounted on its top.

A direction-switching device 3 is enveloped onto the cam rod 1. The direction-switching device 3 includes a pair of guiding barrels 31 that are movable along the cam rod 1. Each of the guiding barrels 31 is provided with a guiding wedge 311 at the inner wall, and each of the guiding wedges 311 is movable along the spiral grooves 11, respectively, of the cam rod 1. Each of the guiding barrels 31 is further provided with a ratchet wheel 312. However, the operational direction of the ratchet wheels 312 is opposite to each other. An enclosure 32 is further enveloped onto those two guiding barrels 31. The periphery of the enclosure 32 is provided with a pair of movable biasing tabs 33, and each of the biasing tabs 33 can be selectively engaged with the ratchet teeth of the ratchet wheel 312. Those two biasing tabs 33 are mounted with a sliding switch 34 that has a resilient plate 341 thereon for positioning the sliding switch 34 at a selected position. Each end of the resilient plate 341 of the sliding switch 34 is pressed against one of the biasing tabs 33. The enclosure 32 is further enveloped with a housing 35 that has an opening such that the sliding switch 34 is projected over the housing 35. The inner wall of the enclosure 32 is further provided with a driving wedge 321.

An anchoring root 4 is disposed beneath the direction-switching device 3. The anchoring root 4 is provided with a spiral thread at its outer wall. The overall configuration of the anchoring root 4 is similar to a screw with a large dimension. The top of the anchoring root 4 is provided with a pilot hole 41 for receiving the lower end of the cam rod 1. The anchoring root 4 is further provided with a flange portion 42 in which a connecting socket 421 is provided. The driving wedge 321 of the enclosure 32 of the direction-switching device 3 can be releasably engaged with the socket 421 of the anchoring root 4.

By this arrangement, when the direction-switching device 3 is installed onto the cam rod 1, the guiding wedges 311 of the guiding barrels 31 of the direction-switching device 3 are movably received within the spiral grooves 11 of the cam rod 1. When the sliding switch 34 is moved downward and/or upward, the resilient plate 341 may selectively press against the biasing tabs 33. When the resilient plate 341 is pressed onto one of the biasing tabs 33, the pressed biasing tab 33 will be moved upward such that the corresponding ratchet wheel 312 of the guiding barrel 31 is released therefrom. Meanwhile, the other biasing tab 33 that is not pressed by the resilient plate 341 will be engaged with the ratchet wheel 312 of the second guiding barrel 31. By this arrangement, when the cam rod 1 is depressed or pushed, as the guiding wedge 311 is movably received within one of the spiral grooves 11, the direction-switching device 3 is also rotated. By this arrangement, when the sliding switch 34 is moved upward or downward, the rotation of the direction-switching device 3 can be readily changed between clockwise or counterclockwise.

Figure 3:
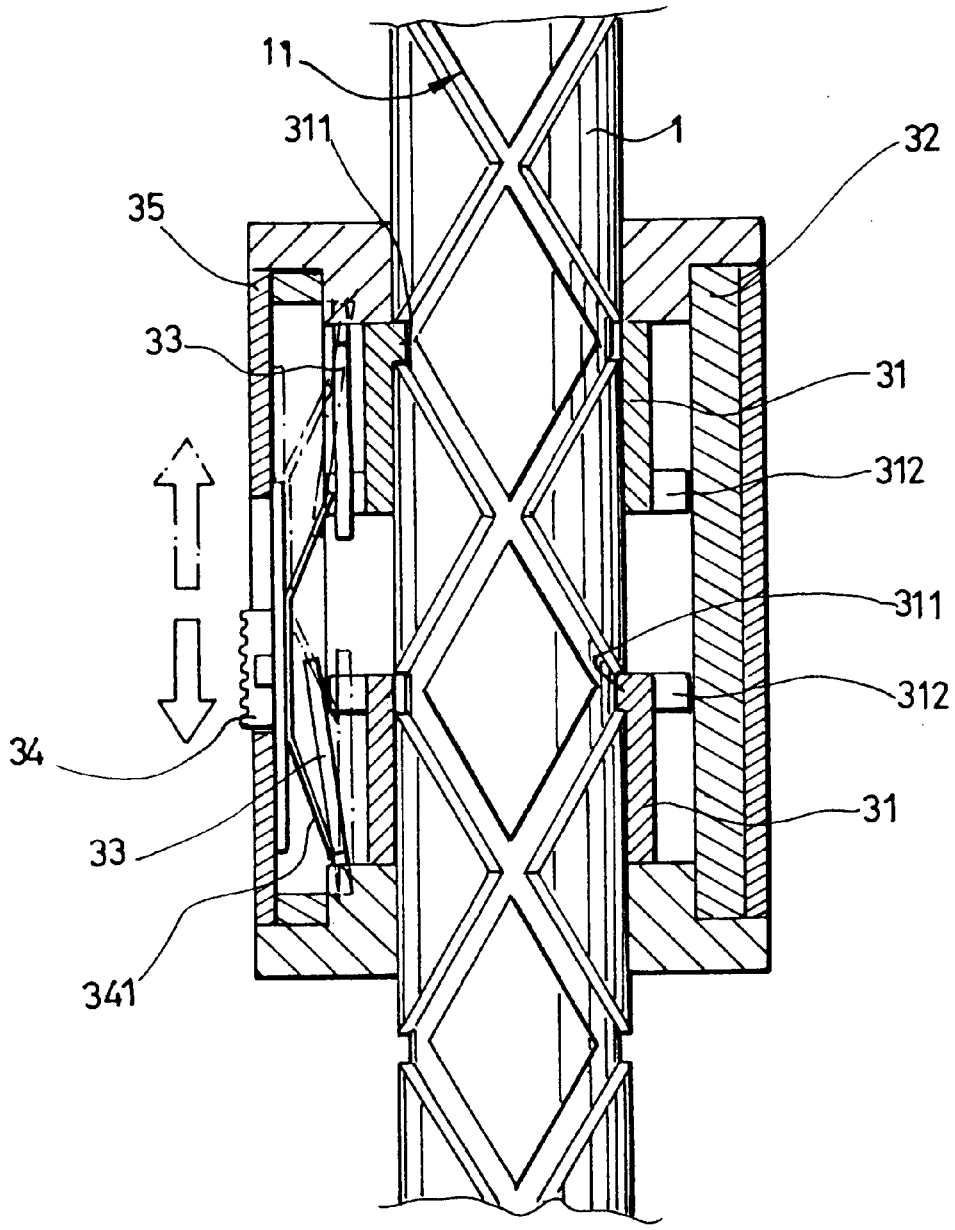
FIG. 3 is a schematic illustration showing the direction-switching portion of the anchoring device.
Figure 4:
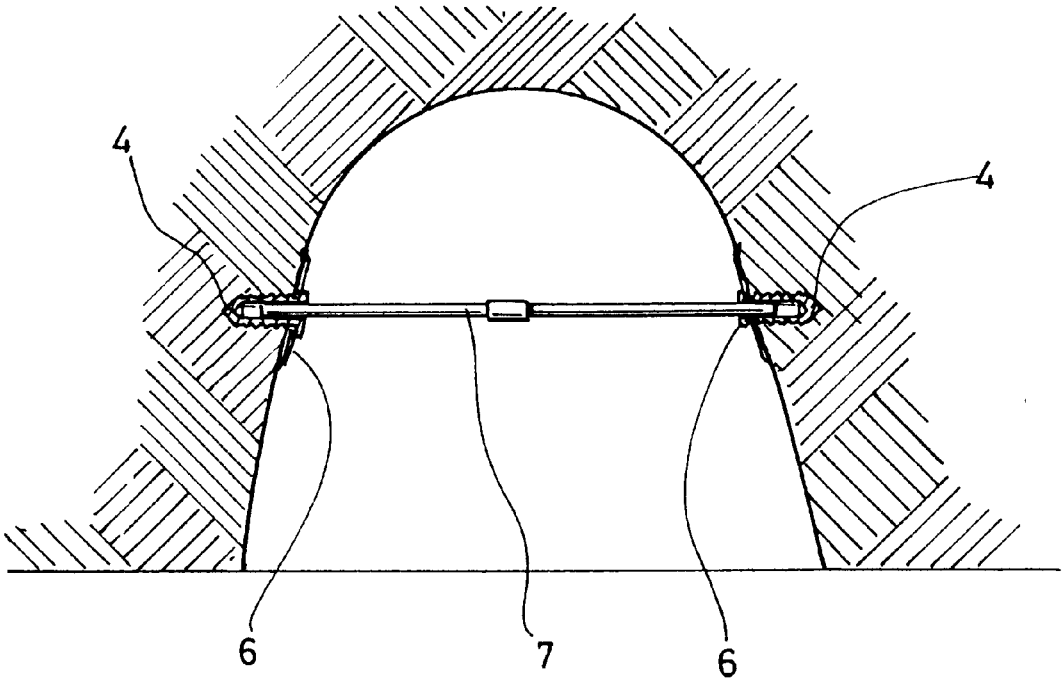
FIG. 4 is a schematic illustration showing the anchoring device bridged between two walls.
Figure 5:
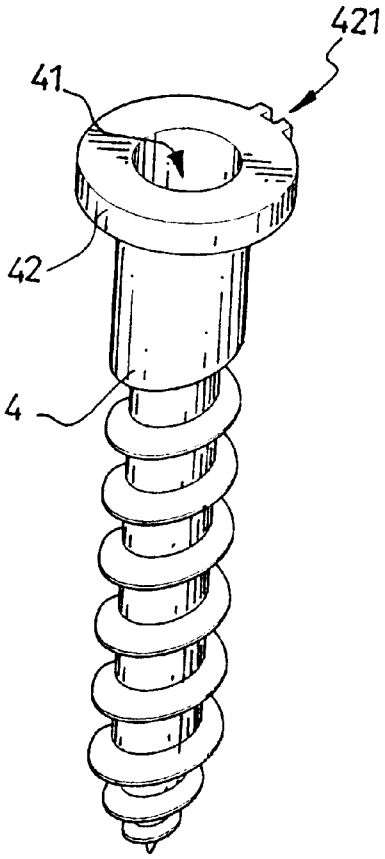
FIG. 5 is another embodiment of the anchoring device made according to the present invention.

When the sliding switch 34 is disposed at the central position, the resilient plate 341 beneath the sliding switch 34 is pressed against the biasing tabs 33 simultaneously such that the biasing tabs 33 are engaged to both of the ratchet wheels 312 of the guiding barrels 31. Since the rotation of those guiding barrels 33 are opposite to each other, the direction-switching device 3 will not be rotated, as clearly shown in FIG. 3.

In use, the sharp end of the anchoring root 4 can be punched into the ground a little bit, and then the user can step down on pedal 2 of the cam rod 1. Because the cam rod 1 is mounted with a direction-switching device 3, when the cam rod 1 is depressed, the direction-switching device 3 is rotated immediately. Also, the driving wedge 321 of the direction-switching device 3 is engaged with the socket 421 of the anchoring root 4, so that when the direction-switching device 3 is rotated, the anchoring root 4 is also rotated. As the anchoring root 4 is provided with a spiral thread at the outer wall, the anchoring root 4 can be screwed into the ground gradually as the cam rod 1 is depressed. When the anchoring root 4 is fixedly positioned, the cam rod 1 can then be disconnected and removed from the anchoring root 4. Then a pole or stick can be inserted into the pilot hole 41 of the anchoring root 4.

In one embodiment, the engagement between the direction-switching device 3 and the anchoring root 4 can be facilitated by means of a locking pin. In another embodiment, the driving wedge 321 can be disposed beneath the direction-switching device 3, while the socket 421 is disposed at the top portion of the anchoring root 4. By this arrangement, the engagement between the direction-switching device 3 and the anchoring root 4 can be quickly performed.

So by simple depression of the cam rod 1, the anchoring root 4 can be driven into the ground. The user does not need to dig a hole in the ground, and therefore this device is very convenient for the user. Also, as no hole is dug, the density of the ground around the screwed in anchoring root 4 is increased instead of decreased. As a result, the anchoring root 4 can be firmly rooted into the ground, and the pole that is inserted into the pilot hole 41 can be firmly supported therein.

When the user needs to mount a pole or rod in a slope or between two adjacent walls, the anchoring root 4 can be first screwed into the ground or walls, and then a telescopic rod 7 can be inserted into the pilot hole 41 of the anchoring root 4. Accordingly, the telescopic rod 7 can be used for hanging articles or for other applications.

When the anchoring root 4 is to be removed from the ground, the cam rod 1 can be first inserted into the pilot hole 41 and can then engage the driving wedge 321 of the direction-switching device 3 with the socket 421 of the anchoring root 4. With a suitable positioning of the sliding switch 34, the anchoring root 4 can be unscrewed from the ground when the cam rod 1 is depressed.

The length of the anchoring root 4 can be selected by the user according to the density or hardness of the ground.

In order to provide a firm support for the anchoring root 4 when it is screwed into the ground, a supporting umbrella 6 can be connected to the lower end of the anchoring root 4. The supporting umbrella 6 includes a collar 61 on which a plurality of protecting blades 62 are positioned. Those protecting blades 62 can be extended outward to provide an enlarged support for the anchoring root 4, as clearly shown in FIG. 2. By this arrangement, when the anchoring root 4 is screwed into the ground or the wall, the supporting umbrella 6 also can be fixedly disposed thereon. As a result of the enlarged support provided by the protecting blades 62, the anchoring root 4 is benefitted with an enlarged supporting base. For example, this can be used to support a fishing rod while fishing.

When the protecting umbrella 6 is not used, the protecting blades can be folded downward to protect the anchoring root 4, as shown in FIG. 1.

In another embodiment, the pedal 2 on the cam rod 1 can be replaced with a pushing rod that can be used to drive the anchoring root 4 into the ground. In yet another embodiment, the cam rod 1 can be fixedly mounted onto the end portion and by actuating the pushing rod, the anchoring root 4 can be driven into the ground.

I claim:

1. An anchoring device, comprising:

a cam rod having an elongate shape and being provided with dual-spiral grooves that are orthogonal to each other, said cam rod further including a pedal mounted on a top thereof;

a direction-switching device enveloped onto said cam rod, said direction-switching device including a pair of guiding barrels that are movable along said cam rod, each of said guiding barrels being provided with a guiding wedge at an inner wall thereof and each of said guiding wedges being movable along one of said dual-spiral grooves of said cam rod such that the guiding wedge that is received in the respective spiral grooves makes said guiding barrels movable along said cam rod, each of said guiding barrels being further provided with a ratchet wheel, wherein an operational direction of each of said ratchet wheels is opposite to the other ratchet wheel, an enclosure being further enveloped onto said guiding barrels, a periphery of said enclosure being provided with a pair of movable biasing tabs wherein each of said biasing tabs can be selectively engaged with ratchet teeth of said ratchet wheels, said biasing tabs being mounted with a sliding switch that has a resilient plate thereon for positioning said sliding switch at a selected position, wherein both ends of said resilient plate of said sliding switch are selectively pressed against said biasing tabs, said enclosure being further enveloped with a housing that has an opening such that said sliding switch extends out of said housing, an interior wall of the enclosure being further provided with a driving wedge; and an anchoring root disposed beneath said direction-switching device, said anchoring root being provided with a spiral thread at an outer wall thereof, a top of said anchoring root being provided with a pilot hole for receiving a lower end of said cam rod, said anchoring root being further provided with a flange portion in which a connecting socket is provided, and said driving wedge of said enclosure of said direction-switching device being releasably engaged with said socket of said anchoring root.

2. An anchoring device as recited in claim 1, wherein a lower portion of the flange of said anchoring root is attached to a protecting umbrella that can be selectively disposed between an extended position and a stored position, said protecting umbrella including a collar on which a plurality of protecting blades are pivotally disposed, wherein said protecting blades are retractable so as to protect said anchoring root and fully extendable to provide an enlarged support for said anchoring root.

3. An anchoring device, comprising:

a cam rod having an elongate shape and provided with a first spiral groove and a second spiral groove on an outer surface thereof, a direction-switching device into which the cam rod is inserted, the direction-switching device including:

(a) a first guiding barrel, wherein an inner wall of the first guiding barrel includes a first guiding wedge that is received in the first spiral groove of the cam rod, wherein the first guiding barrel is movable along the cam rod via engagement of the first guiding wedge in the first spiral groove, and wherein the first guiding barrel further includes a first ratchet wheel having a first operational direction, (b) a second guiding barrel, wherein an inner wall of the second guiding barrel includes a second guiding wedge that is received in the second spiral groove of the cam rod, wherein the second guiding barrel is movable along the cam rod via engagement of the second guiding wedge in the second spiral groove, and wherein the second guiding barrel further includes a second ratchet wheel having a second operational direction, wherein the second operational direction is opposite the first operational direction, (c) an enclosure around the first and second guiding barrels, (d) a first movable biasing tab provided at a periphery of the enclosure, wherein the first movable biasing tab can selectively engage teeth of the first ratchet wheel, (e) a second movable biasing tab provided at the periphery of the enclosure, wherein the second movable biasing tab can selectively engage teeth of the second ratchet wheel, (f) a resilient plate selectively pressing against the first or the second movable biasing tabs, (g) a sliding switch engaged with the resilient plate, wherein the resilient plate holds the sliding switch at a selected position, (h) a driving wedge extending from a wall of the enclosure, and (i) a housing around the enclosure, wherein the housing defines an opening such that a portion of the sliding switch extends out of the opening, a pedal mounted on the cam rod for pushing the cam rod into the direction-switching device, and an anchoring root engaged with the direction-switching device, wherein the anchoring root includes:

(a) an elongate body having a spiral thread on an outer wall thereof, (b) a flange including a pilot hole defined therein, wherein the flange includes a connecting socket that releasably engages the driving wedge of the enclosure.

4. An anchoring device according to claim 3, wherein the first spiral groove of the cam rod is orthogonal to the second spiral groove.

5. An anchoring device according to claim 3, wherein the driving wedge extends from an interior wall of the enclosure.

6. An anchoring device according to claim 5, wherein the connecting socket of the flange is provided on an outer periphery of the flange.

7. An anchoring device according to claim 3, wherein the connecting socket of the flange is provided on an outer periphery of the flange.

8. An anchoring device according to claim 3, further including a protecting umbrella attached to the anchoring root.

9. An anchoring device according to claim 8, wherein the protecting umbrella includes a collar and a plurality of protect ing blades pivotally attached at the collar.

* * * * *